United States Patent [19]

Berger et al.

[11] Patent Number: 4,513,939

[45] Date of Patent: Apr. 30, 1985

[54] VIBRATION ABSORPTION MOUNTING FOR A ROOFTOP AIR HANDLING UNIT

[76] Inventors: Richard C. Berger, Off Split Rock Rd., Syosset, N.Y. 11791; Paul L. Berger, 28 Moss La., Jericho, N.Y. 11753

[21] Appl. No.: 540,511

[22] Filed: Oct. 11, 1983

[51] Int. Cl.[3] ..... E02D 27/44; F16M 9/00; E04B 1/36

[52] U.S. Cl. ..... 248/544; 248/561; 248/624; 52/27

[58] Field of Search ..... 52/27, 393, 60, 200; 248/571, 561, 601, 603, 624, 544

[56] References Cited

U.S. PATENT DOCUMENTS

| | | | |
|---|---|---|---|
| 2,173,342 | 9/1939 | Rosenzweig | 248/624 |
| 2,919,476 | 1/1960 | Fritz | 52/393 |
| 2,979,297 | 4/1961 | Suozzo | 248/544 X |
| 3,878,655 | 4/1975 | Toth et al. | 52/27 |
| 4,238,102 | 12/1980 | Salter | 248/561 X |
| 4,403,763 | 9/1983 | Dold | 248/561 |

*Primary Examiner*—Henry E. Raduazo
*Assistant Examiner*—C. Dennison
*Attorney, Agent, or Firm*—Bauer & Amer

[57] ABSTRACT

An improved arrangement of so-called upper and lower curbs with interposed springs having an interconnected condition allowing for their delivery to an installation site as a single unit, and at said site being readily released from each other to then allow vibratory movement in said upper curb relative to said lower curb on said interposed springs, and wherein the release is produced by the force urgency in the springs which dampen the vibration of the air handling unit which is mounted on the curbs.

3 Claims, 10 Drawing Figures

VIBRATION ABSORPTION MOUNTING FOR A ROOFTOP AIR HANDLING UNIT

The present invention relates generally to a vibration absorption system of the type described and illustrated in U.S. Pat. No. 3,878,655, wherein there is dampening of the vibration of a rooftop mounted heating and air-conditioning unit, and more particularly to improvements in such a system which significantly facilitates the installation and weather-proofing thereof.

As generally understood from the patent literature, and as exemplified by U.S. Pat. No. 3,878,655, so-called upper and lower curbs, with springs in interposed positions therebetween, are used to complete rooftop mountings of large heating and air-conditioning units, wherein vibration occasioned by the operation of the compressor of the unit is absorbed by the springs and thus does not dislodge or otherwise adversely effect the firmness of the attachment of the so-called lower curb to the rooftop, the unit being mounted on said upper curb and thus being supported on said interposed springs. In this manner, the upper curb with its load is free to move in vibratory movement relative to the stationary lower curb during operation of the air handling unit. However, before the installation of the unit on said curbs, it would be preferable if the curbs were able to be handled as a single unit in the manner in which they are delivered to the rooftop site, and also during the application to some of weather-proofing materials. Undoubtedly because in use the curbs must be separated, they are also supplied separately to the rooftop site for attachment to the air handling unit and roof respectively, and also in said separated condition are rendered weather-proof, even though this adds to the installation cost and difficulty in achieving the proper mounting for the air handling unit.

Broadly, it is an object of the present invention to provide an improved vibration absorption mounting for a rooftop air handling unit overcoming the foregoing and other shortcomings of the prior art. More particularly, it is an object to provide the mounting curbs in an initial interconnected condition, and to use the vibration-dampening springs to effectuate their release from each other, so that the load-supporting upper curb is free to vibrate, as it must during operation of the air handling unit, relative to the stationarily mounted lower curb.

An improved pre-assembled vibration absorption system for a rooftop mounted heating and air-conditioning unit demonstrating objects and advantages of the present invention includes, in combination, a rectangular shaped upper curb adapted to have in attached relation thereto said heating and air-conditioning unit and also is provided with plural bolts each bolted to extend in depending relation from said upper curb at selected locations therealong. A rectangular shaped lower curb is adapted to be mounted on said rooftop in supporting relation beneath the upper curb, and at each location of one of the depending bolts, there is an inverted U-shaped housing attached to the lower curb bounding a compartment for a spring and having an opening in the top thereof through which the depending bolt has an operative position projected into said compartment. A first nut is threadably engaged to each bolt in said compartment adjacent the underside of the top of said housing and thus is effective to initially bolt said housing, and thus the lower curb, to the upper curb, such that the bolted together upper and lower curbs are delivered as a single unit to a rooftop site. Between the bolted curbs, and about each bolt there is a compressible helical spring disposed in each said compartment, and a second nut is positioned beneath said first nut and is downwardly adjustable along said bolt so as to cause compression of the spring and a corresponding increase in the upward force urgency therein. As a result, following the unbolting of the upper and lower curbs from each other by the threadable adjustment of each said first nut, the invention contemplates the threadable adjustment of each said second nut down along the bolt which causes compression of the helical spring and a force urgency therein effectively to lift the upper curb into a spaced clearance position above the lower curb, to thereby permit vibrating movement of the upper curb relative to the stationarily mounted lower curb.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 6:
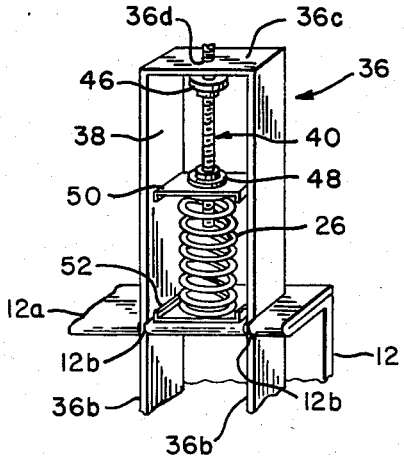
Figure 5:
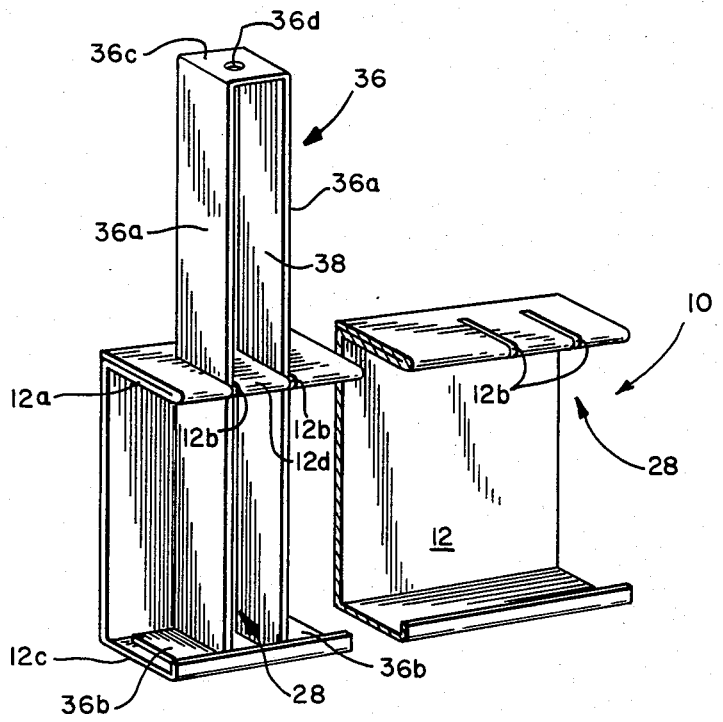
FIG. 5 is an isolated perspective view illustrating the manner in which the spring housing is assembled to the lower curb.
Figure 7A:
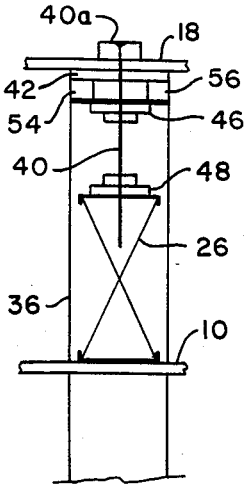
Figure 7B:
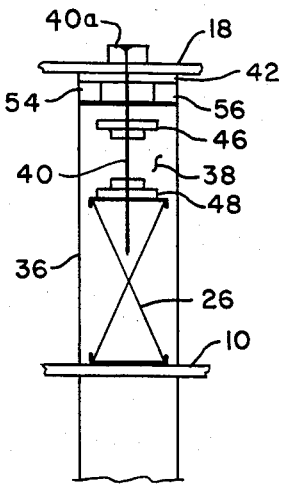
Figure 7C:
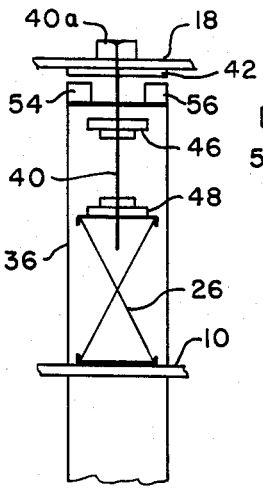
Figure 7D:
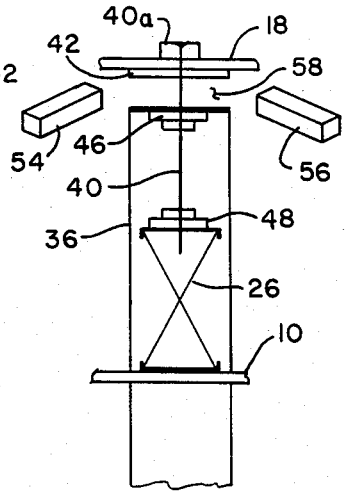

FIG. 6 is a partial perspective view, illustrating the operative position of the spring and of the depending bolt in the compartment formed in the housing of FIG. 5; and FIGS. *7a–d* are diagramatic view, in side elevation, illustrating the step-by-step procedure for releasing the upper and lower curbs from each other, and thereby allowing vibratory movement of the upper curb relative to the lower curb as permitted by the springs.

The rooftop mounting to be described in detail herein is of the general classification illustrated and described in the patent literature, as for example, in U.S. Pat. No. 3,878,655, which is incorporated herein by reference in its entirety. For office buildings, it is conventional to mount air handling units, such as heating and air-conditioning units, on the rooftop using a cooperating pair of so-called curbs. Typically, the lower curb, generally designated 10 in FIG. 1, consists of four rails 12 joined to each other in any appropriate manner, as by brackets 14, so as to form a rectangular shape as illustrated, which structure is then stationarily mounted to the rooftop and bounds an internal rectangular opening 16 which is coextensive with a rooftop area in which appropriate openings are made for the conduits and the like which must be attached to the air handling units.

Figure 1:
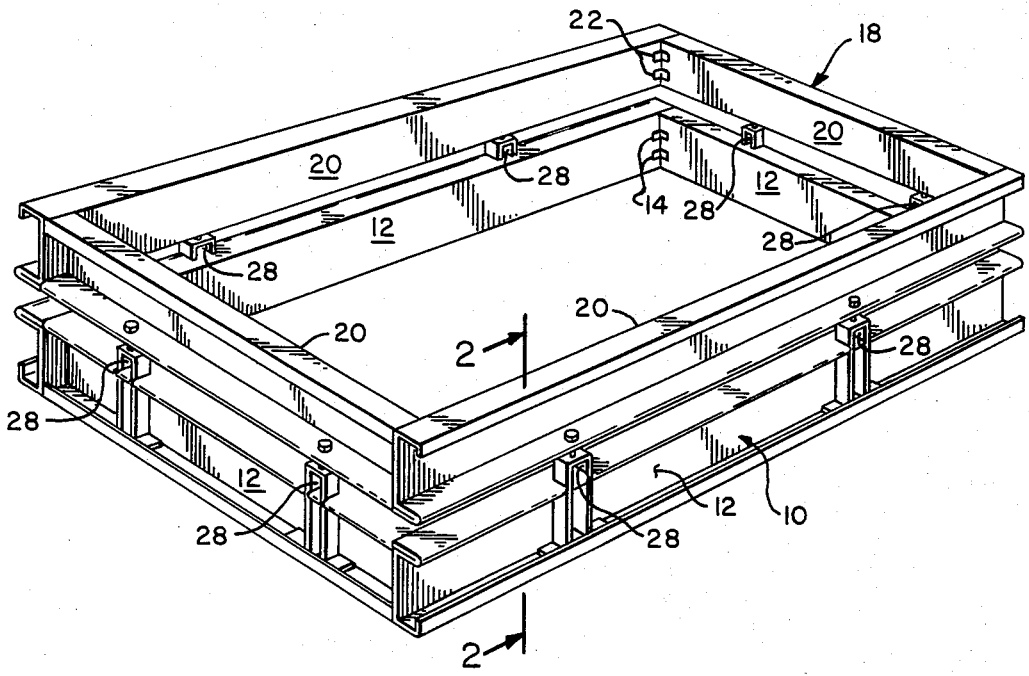
FIG. 1 is a perspective view of so-called curbs for achieving a rooftop mounting of an air handling unit, in which the air handling unit and conventional weather-proofing materials have been omitted to better illustrate structural details of said curbs.
Figure 2:
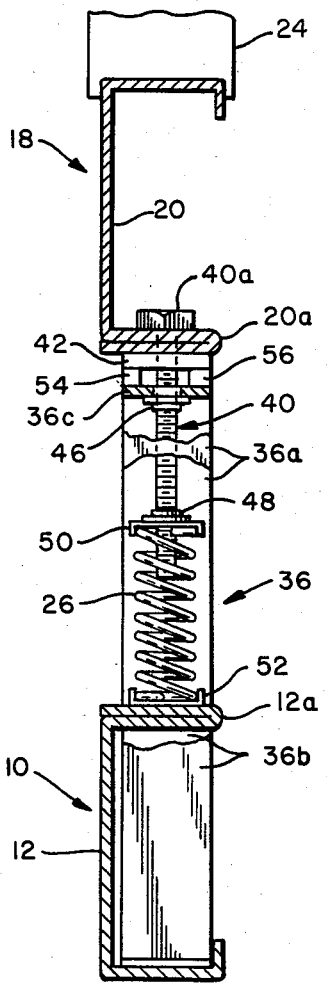
FIG. 2 is a side elevational view, in section taken along line 2—2 of FIG. 1, illustrating the curbs in an interconnected condition and thus prior to their release from each other incident to allowing the illustrated spring to absorb vibration of the air handling unit supported on said curbs.

Cooperating with the lower curb 10 is an upper curb, generally designated 18 in FIG. 1, which similarly is formed into a rectangular shape by rails 20 appropriately connected to each other, also as at corners 22. When an air handling unit such as unit 24, in FIG. 2, is appropriately mounted on the upper curb 18, it is necessary that the upper curb 18 have a degree of movement relative to the stationarily mounted lower curb 10 so that the vibration produced during the operation of the air handling unit 24, by its compressor or the like, does not result in a break down of the stationary mounting that has been provided to the lower curb 10. Stated another way, the vibration which is produced during the operation of the air handling unit 24 and transmitted to the upper curb 18 must not be permitted to be transmitted to the lower curb 10 and thus, in these type of rooftop installations, it is arranged that the vibration be absorbed by springs, herein individually and collectively designated 26, which are provided with an interposed position between the upper and lower curbs 18 and 10. Thus, the spring 26 illustrated in FIG. 2, is but one of eight, each provided between the curbs at select locations designated individually and collectively 28 in FIG. 1.

Thus far, what has been described are general aspects of a typical vibration absorbing system for a rooftop mounted heating and air-conditioning unit. The improvements according to the present invention which are applied to this system are those which permit the curbs 18 and 10 to be delivered in a bolted together condition to the rooftop installation site, to be installed at that site as a single unit, to have the air handling unit 24 placed in surmounted relation on the upper curb 18, and to then have the two curbs released from each other to thereby bring into play the springs 27 to absorb the vibratory movement in the upper curb 18 relative to the stationarily mounted lower curb 10. This is in sharp contrast to the present prior art practice in which the lower curb 10 and upper curb 18 are delivered in an unassembled condition to the rooftop site, and the lower curb 10 is then stationarily installed in place while the upper curb is assembled to the air handling unit. The two units are then placed in superposed relation with the vibration-absorbing springs in an interposed position therebetween. At this time, the prior art also contemplates the application of weather-proofing components about the two curbs.

Figure 3:
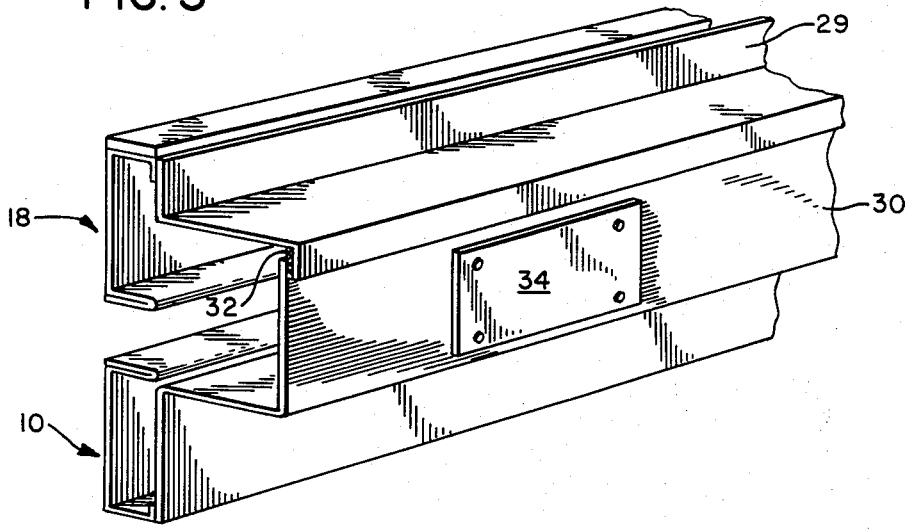
FIG. 3 is a partial perspective view of the curbs with weather-proofing materials attached thereto.

Before detailing the manner by which the two curbs 18 and 10 are delivered to the installation site in a bolted together condition and then released from each other, it is helpful to refer to FIG. 3 in which it is to be assumed that the curbs 18 and 10 are bolted together, in a manner which will soon be described, and that in this bolted condition there is applied to the upper curb 18 in any appropriate manner, by welding or bolting, a weather-proofing attachment 29, and similarly to the lower curb 10, a weather-proofing attachment 30, the two attachments having an elastomeric seal 32 at overlapping edges, to thereby provide in a well understood manner, a barrier against rain, snow, and the like from entering into the interior of the curbs 18 and 10 and thus possibly causing damage to the conduits connected to the air handling air. In addition to the use of shields 29 and 30, the weather-proofing procedure may also include the use of conventional insulation materials that are effective to render the installation weather-proof and weather tight. Also to be noted in FIG. 3 is the location of a removable plate 34 which, upon removal, will be understood to provide an access opening to each of the spring locations 28. As will now be described, through the opening uncovered by removal of the plate 34, it is readily possible to release the two curbs 18 and 10 from their interconnected or bolted together condition, whereupon the upper curb 18 has a degree of vibratory movement relative to the stationarily mounted lower curb 10 to the extent that is permitted by the previously noted springs 26.

As is perhaps best illustrated in FIG. 5, in which it is intended to illustrate two of the spring locations 28 along one of the rails 12 which is one of the structural units of the lower curb 10, at each location 28 a reinforced laterally extending upper lip **12*a* of the rail 12 has two slots 12*b* to receive therein an inverted U-shaped spring housing, generally designated 36. That is, the vertical sides 36*a* are inserted in the slos 12*b* and this position made permanent by appropriately connecting, as by welding or the like, laterally extending flanges 36*b* to a laterally extending leg 12*c* of the rail 12. As a result, the housing 36 provides a spring compartment 38 that is bounded by the vertical housing wall portions 36*a*, the segment 12*d* of rail 12, and the top 36*c*** of the housing.

Figure 4:
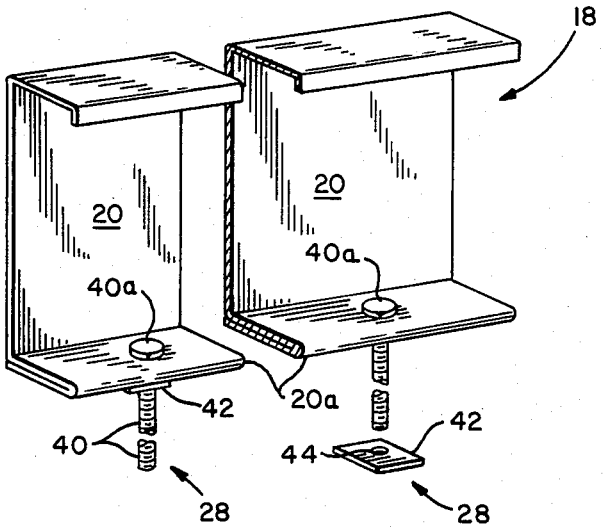
FIG. 4 is a perspective view of two bolt locations along the upper curb which, by comparison, illustrates the manner in which the bolt is attached to said upper curb.

Reference should now be made to FIG. 4, in which it is also intended to illustrate two of the spring locations 28, but this time along the rail 20 of the upper curb 18. At each location 28, a threaded bolt 40 is inserted in a depending relation through an opening in the reinforced laterally extending leg **20*a* of the rail 20, each said bolt being understood to be of a sufficient length to extend well into the spring compartment 38, for a reason which will soon be apparent. However, prior to the assembly of the two curbs 18 and 10 which requires the placement of the bolt 40 into the compartment 38, each bolt 40 is securely connected to the upper curb 18, and for this purpose a threaded plate 42 is used having a threaded opening 44 for making threaded engagement to the bolt 40. As shown to the left in FIG. 4, the plate 42 is threaded all the way up on the bolt 40 to thereby engage the leg 20*a* between itself and the bolt head 40*a***.

The assembly of the two curbs 18 and 10, as well as the assembly of components on or about the depending bolts 40, can best be understood from FIGS. 2 and 6 to which reference should now be made. The upper curb 18 with its depending bolts 40 is placed in superposed relation above the lower curb 10 with the threaded lower portion of each bolt 40 projected through an opening **36*d* in the housing top 36*c* and thus into the spring compartment 38. A lock nut 46 is threadably engaged to the bolt 40, and below that, bolt 40 has threadably engaged thereon a spring-compressing nut 48. Next, an upper spring retaining member 50 is placed about the bolt 40 which cooperates with a lower spring retaining member 52 to hold the previously-noted helical spring 26 in a slightly compressed condition beneath the nut 48**.

In the condition just described, it should therefore be readily understood that the two curbs 18 and 10 are in a bolted together condition, this condition being achieved by virtue of the leg **20*a* of the upper curb 18 being engaged between the bolt head 40*a* and the locking plate 42 and the locking nut 46 being firmly against the underside of the top 36*c* of the housing 36 which at its bottom is firmly connected to the lower curb 10. At this point, it should be noted that interposed between the plate 42 and the top 36*c* are two removable shims or spacing blocks 54 and 56, the removal of which at this time is not possible because of their firm engagement between the plate 42 and top 36***c*.

At this point in the description, it is helpful to refer to FIGS. *7a–7b*, in which there is diagramatically illustrated the step-by-step procedure by which the bolted together upper and lower curbs 18 and 10 are released from each other so that curb 18 can vibrate on the springs 26 relative to the stationarily mounted curb 10. More particularly, as illustrated in FIG. *7a*, upper curb 18 is interconnected by each of the bolts 40 to lower curb 10, the situation depicted in FIG. *7a* being essentially that illustrated in FIG. 2. After achieving the rooftop installation of the interconnected curbs 18 and 10, and thus achieving the benefit of weather-proofing and installing these curbs as a single unit, access is obtained through the weather-proofing shield to each of the spring compartments 38. The invention then contemplates unthreading the lock nut 46 slightly down along bolt 40 to provide the condition diagramatically depicted in FIG. *7b*.

Next, the spring compressing nut 48 is turned on the bolt 40 so that is partakes of a descending movement down along bolt 40, and as a result causes compression of the spring 26. As this compression in the spring 26 builds up, it causes the spring to exert an increasing upward force urgency against the nut 48, and thus against the bolt 40 to which the nut 48 is threadably engaged. Eventually, the upward force urgency of the spring 26 equals the load or the weight of the air handling unit 24 which is mounted on the upper curb 18, and then even slightly exceeds this load. When this occurs, the upper curb 18 which is attached to the bolt 40 between bolt head 40*a* and pressure or bearing plate 42, is lifted clear of the spacing blocks 54 and 56.

The blocks 54, 56 are then removed, as illustrated in FIG. *7d*, and this provides adequate clearance 58 between the upper curb 18 and the housing extension 36 of the lower curb 10 for the vibratory movement that occurs during operation of the air handling unit which is mounted on the upper curb 18. Stated another way, the vibration which is transmitted to the upper curb 18 by the air handling unit is effectively absorbed by the springs 26 and the relative movement which must occur between the vibrating upper curb 18 and the stationarily mounted curb 10 occurs in the clearance 58. Thus, the curbs 18 and 10 are delivered in an optimum interconnected condition for rooftop installation, and after which they are released from each other to provide a vibration absorption system that is especially useful for supporting rooftop mounted heating and air-conditioning units.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An improved pre-assembled vibration absorption system for a rooftop mounted air handling unit comprising, in combination, a rectangular shaped upper curb adapted to have in attached relation thereto said air handling unit, plural bolts each bolted to extend in depending relation from said upper curb at selected locations therealong, a rectangular shaped lower curb adapted to be mounted on said rooftop in supporting relation beneath said upper curb, and at each location of one said depending bolt an inverted U-shaped housing attached to said lower curb bounding a compartment for a spring and having an opening in the top thereof through which said depending bolt has an operative position projected into said compartment, a first nut threadably engaged to said bolt in said compartment adjacent the underside of said top of said housing having an initial operative position bolting said housing to said upper curb such that said upper and lower curbs are correspondingly bolted to each other to facilitate the transit thereof to a rooftop site, a compressible helical spring disposed in each said compartment in surrounding relation about a cooperating depending bolt, and a second nut positioned beneath said first nut and downwardly adjustable along said bolt so as to cause compression of said spring and a corresponding increase in the upward force urgency therein, whereby following the unbolting of said upper and lower curbs from each other by the threadable adjustment of each said first nut the threadable adjustment of each said second nut down along said bolt causes compression of said helical spring and a force urgency therein effective to lift said upper curb into a spaced clearance position above said lower curb, to thereby permit vibrating movement of said upper curb relative to a stationarily mounted lower curb.

2. The improved pre-assembled vibration adsorption system as claimed in claim 1, including unattached spacing blocks that are released for removal upon the threaded adjustment of each said second nut, to thereby contribute to enlarging the clearance provided for vibratory movement of said upper curb in relation to said lower curb.

3. The improved pre-assembled vibration absorption system as claimed in claim 2, including weather shields attached about said interconnected upper and lower curbs and having access openings therethrough for making threadable adjustments in each said second nut.

* * * * *